United States Patent [19]

McCafferty

[11] Patent Number: 4,695,023

[45] Date of Patent: Sep. 22, 1987

[54] PLATFORM ASSEMBLY FOR SLANTED LADDER

[76] Inventor: Stanley E. McCafferty, R.D. #1, McCafferty Rd., Greenville, N.Y. 12083

[21] Appl. No.: 20,697

[22] Filed: Mar. 2, 1987

[51] Int. Cl.[4] ..... E06C 7/14

[52] U.S. Cl. ..... 248/238; 182/45; 182/121; 248/148; 248/237

[58] Field of Search ..... 182/121, 129, 45; 248/238, 237, 148

[56] References Cited

U.S. PATENT DOCUMENTS

| | | | |
|---|---|---|---|
| 1,006,562 | 10/1911 | Kefover | 248/237 |
| 1,159,372 | 11/1915 | Goff | 248/148 |
| 1,471,947 | 10/1923 | Cornelius | 248/237 |
| 1,549,657 | 8/1925 | Dunlap | 248/238 |
| 2,840,424 | 6/1958 | Broderick | 248/237 |
| 4,450,935 | 5/1984 | Gustavus | 248/237 |

*Primary Examiner*—Reinaldo P. Machado

*Attorney, Agent, or Firm*—Charles J. Brown

[57] ABSTRACT

In a platform assembly for a slanted ladder wherein a base is hooked to the ladder and a platform is hinged to the base with a brace pivoted to the platform hold the platform substantially level, improved adjustment means are provided for accomodating different ladder angles characterized by coaxial pins movable simultaneously in opposite directions into and out of a selected pair of aligned holes in spaced side flanges on the platform.

5 Claims, 4 Drawing Figures

PLATFORM ASSEMBLY FOR SLANTED LADDER

BACKGROUND OF THE INVENTION

Various forms of platform assemblies for slanted ladders have been devised to provide a substantially horizontal surface on which workmen may stand or equipment may be placed. Such platforms are particularly applicable to ladders laid directly on a pitched roof surface and held in place by hooks over the crest of the roof. They are applicable as well, however, to ladders which lean against vertical surfaces. Portable adjustable roof platforms described in U.S. Pat. Nos. 1,549,647 and 4,450,935 are typical of such prior art devices.

Conventional platform assemblies include a base adapted to be hooked to and lie against rungs of a ladder and a platform hinged to the base. Some form of brace is then provided between the platform and the base to hold the platform and base at an included angle which substantially levels the platform. Prior art adjustment means are known for varying this included angle and the present invention is directed to improvements in such adjustment means.

In U.S. Pat. No. 4,450,935, for example, the adjustment means consists of a crank and screw which operate a toggle on the brace. The crank and screw device, however, is susceptible of inadvertent turning because of its exposed position on the assembly. Also the brace underlies the platform at closely spaced points so that the platform has what approaches a three-point support rather than a four-point support and therefore lacks optimum stability. The design of U.S. Pat. No. 1,549,657 provides hooked bars and locking means for adjustment which are somewhat complicated and clumsy to operate. In addition the support given by the brace to the platform in that design has the instability of a three-point support.

The prior art platform assemblies are dificient in that they involve either complicated manipulation for adjustment or are subject to unintentional operation of the adjustment means or provide insufficient stability to the platform.

SUMMARY OF THE INVENTION

The present invention is applicable to a platform assembly for a slanted ladder where the base is to be hooked to and locked against rungs of the ladder and where a platform is hinged to the base. A brace is pivoted to the platform to abut the base and hold the platform and base at an included angle which substantially levels the platform. The invention provides adjustment means for varying the included angle to accommodate different ladder angles. The adjustment means includes a pair or parallel side flanges on the platform formed with respective arrays of holes in registry with one another and with each array describing an arc about a common axis which is also the pivot axis of the brace on the platform. A pair of coaxial pins on the brace are moveable simultaneiously in opposite directions away from one another into a corresponding pair of coaxial holes in the respective side flanges to fix the platform and brace at a predetermined included angle, and toward one another out of the pair of holes to permit the brace to be pivoted on the platform side flanges so that the pins can be registered with a selected pair of registered holes.

In a preferred form of the invention a platform assembly includes a fixed shaft extending between the platform side flanges and through a pair of co-planar arms on the brace. The arms are movable on the shaft to permit a first angular motion together around the shaft and a second angular motion toward and away from one another in the plane of the shaft. The pins extend laterally from corresponding ends of the arms to fit into and out of a corresponding pair of coaxial holes in the platform side flanges when opposite ends of the arms are turned toward or away from one another in the second angular motion. The pins are operable within any selected pair of the holes by turning the brace and arms around the shaft in the first angular shaft.

It is further preferred that the ends of the arms opposite the pins be spring-biased toward one another to bias the pins away from one another in the second angular motion and into a selected pair of coaxial holes. Preferably the ends of the arms opposite the pins are interconnected by a linkage comprising a manually turnable link pivotable at its midpoint on the brace and a pair of outer links pivotably connecting the ends of the central link with the corresponding ends of the arms opposite the pins. Also the brace preferably includes cover means overlying the linkage for preventing inadvertent turning of the central link.

DESCRIPTION OF PREFERRED EMBODIMENT

Figure 1:
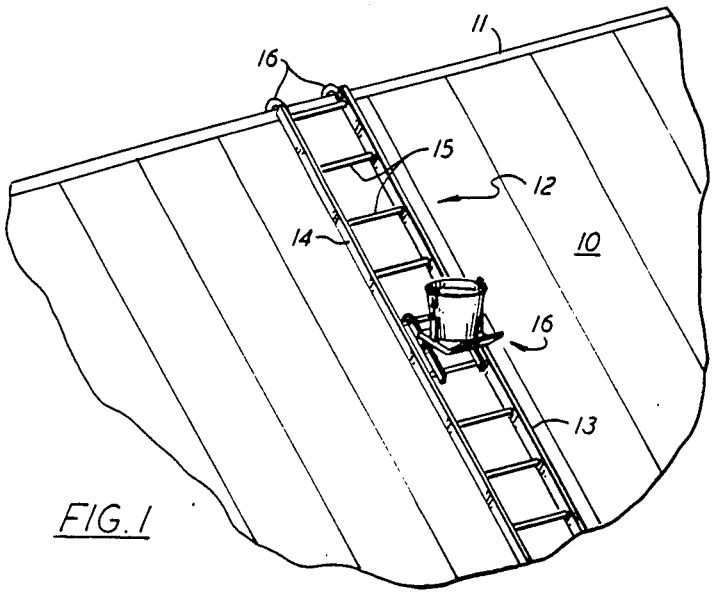
FIG. 1 is a fragmentary perspective view of a slanted ladder applied to a roof surface and equipped with the platform assembly of the invention.

Referring first to FIG. 1 there is applied to a pitched roof 10 having a crest 11 a ladder 12 of the usual form of parallel side rails 13 and 14 and equally spaced rungs 15. Hook means 16 are provided at the upper end of the ladder to overlie the crest 11 of the roof 10 to hold the ladder 12 in place. A platform assembly 16 according to the invention is shown mounted on the ladder 15 and is described in more detail below.

Figure 2:
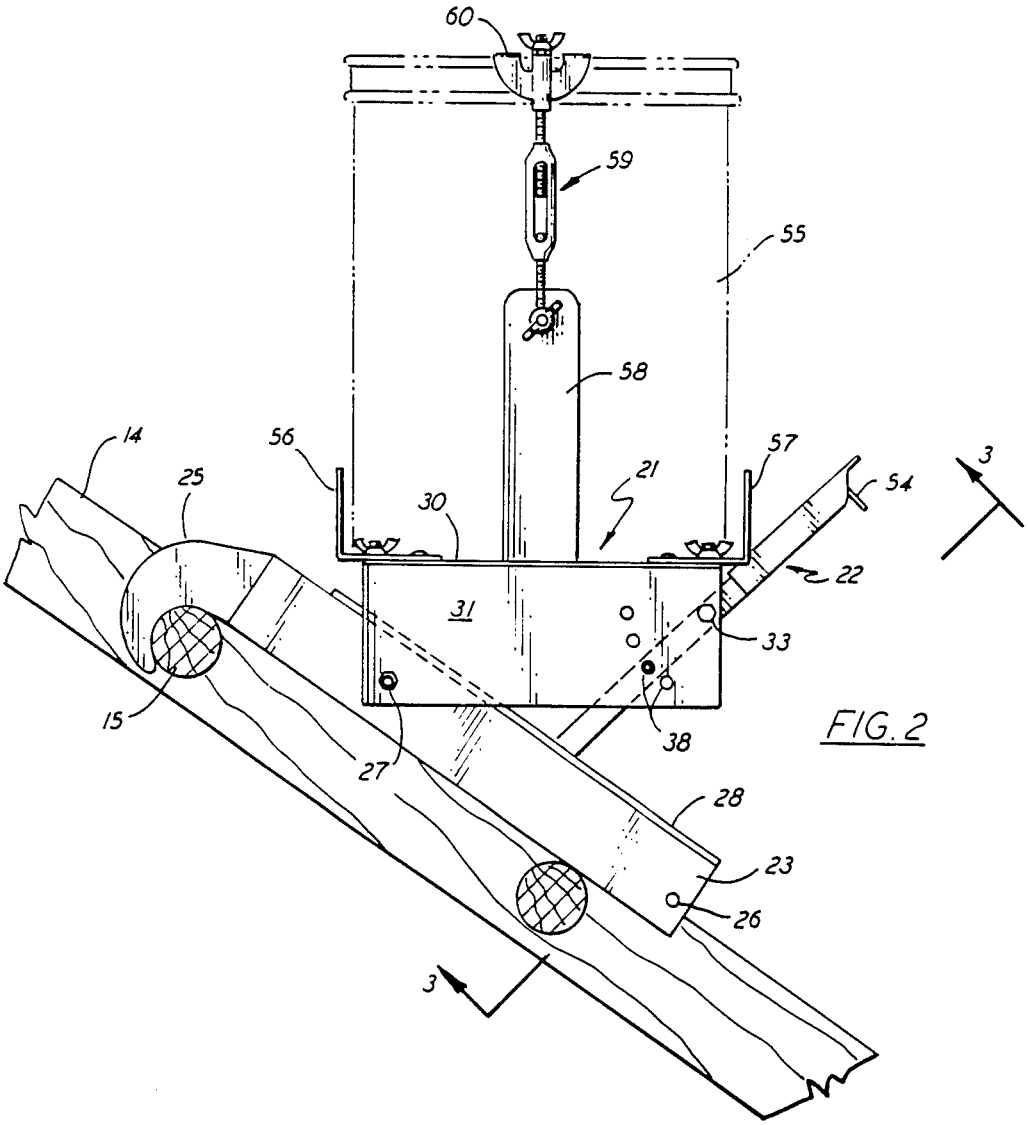
FIG. 2 is an enlarged horizontal elevation of the platform assembly of FIG. 1.

As shown in FIG. 2 the platform assembly of the invention comprises three basic components. There is a base 20 which is adapted to be hooked to and lie against a pair of rungs 15 of the ladder. A platform 21 is hinged to the base 20. Finally a brace 22 is pivoted to the platform 21 to abut the base 20 to hold the platform and base at an included angle which substantially levels the platform 20.

Figure 3:
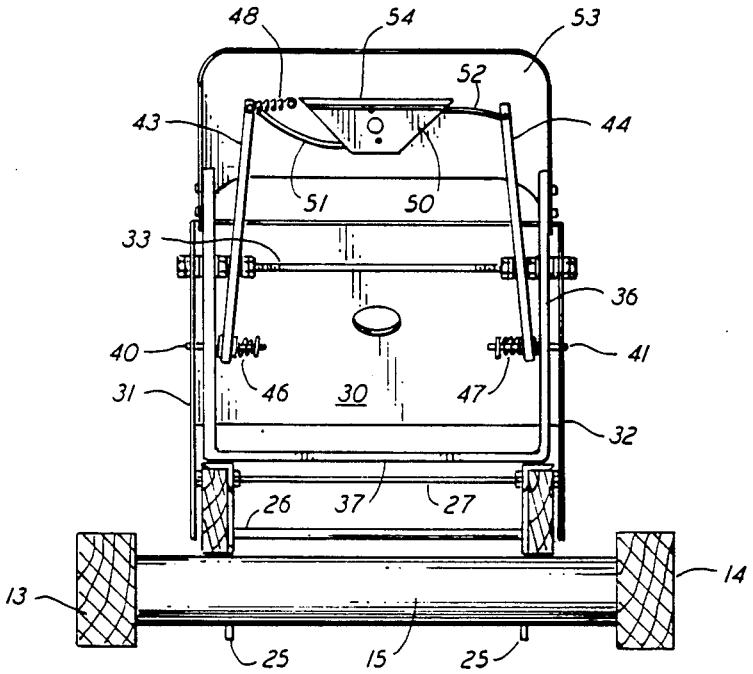
FIG. 3 is a view taken along the line 3—3 of FIG. 2 showing the adjustment means on the underside of the brace with the pins in their inserted position.
Figure 4:
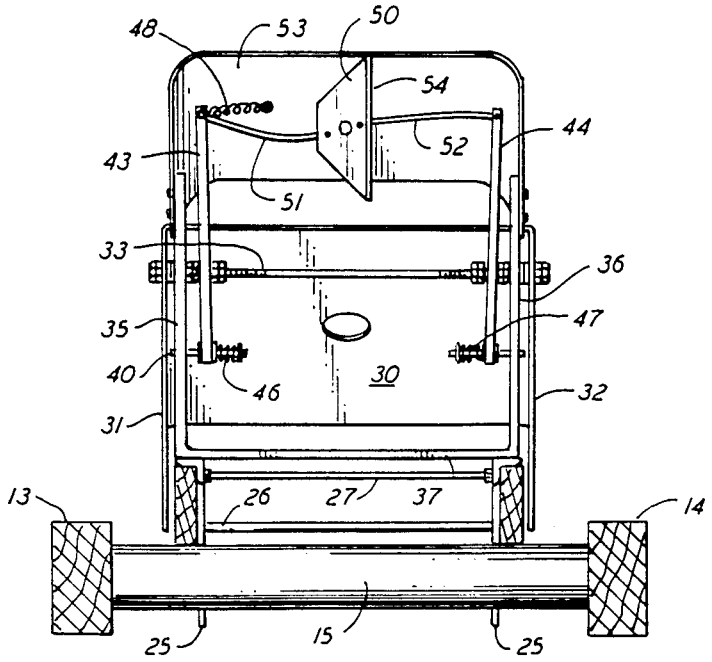
FIG. 4 is a view similar to FIG. 3 showing the adjustment means and pins in withdrawn position.

Referring to FIGS. 3 and 4 as well as FIG. 2, the base 20 includes a pair of parallel side members 23 and 24 which may be of wood, each having at one end a hook element 25 adapted to fit around one of the rungs 15 of the ladder 12. The side members 23 and 24 are held apart in their proper position by a pair of cross rods 26 and 27. Angle bars 28 and 29 are applied along the upper edges of the respective side bars 23 and 24. The forward or upper cross rod 27 also serves as a fixed shaft for hinging of the platform 21. The platform 21 includes a base 30 and also parallel side flanges 31 and 32 through which the cross rod 27 extends.

The brace 22 is pivoted to the platform 21 by another cross rod 33 mounted between the outer end portions of the planges 31 and 32. The brace 22 includes a U-shaped body member with opposite legs 35 and 36 and a connecting portion 37. The connecting portion 37 of the brace 22 abuts the angle bars 28 and 29 of the base 20 to hold the platform and base at an included angle which substantially levels the platform 21.

The pair of parallel side flanges 31 and 32 on the platform 21 are formed with respective arrays of holes 38, one array of which is seen in FIG. 2. The array of holes in the two side flanges are in registry with one another. Each array of holes 38 describes an arc about a common axis which is also the axis of the cross rod 33 serving as the pivot for the brace 22 on the platform 21.

The side legs 35 and 36 of the brace 22 are formed with respective aligned holes through which a pair of coaxial pins 40 and 41 are movable simultaneously in opposite directions. When they are moved away from one another they enter a corresponding pair of the coaxial holes 38 in the respective side flanges 31 and 32 and fix the platform 21 and brace 22 at a predetermined included angle. When they are moved toward one another they are pulled out of the pair of holes in the side flanges to permit the brace 22 to be pivoted on the side flanges 31 and 32 of the platform 21 so that the pins can be locked into a different selected pair of registered holes 38. Such adjustment means includes a pair of co-planar arms 43 and 44 on the brace 22 through which the shaft 33 loosely extends so that the arms are movable on the shaft in two directions: (a) a first angular motion together around the shaft and (b) a second angular motion toward and away from one another in the plane of the shaft. The pins 40 and 41 extend laterally from corresponding ends of the arms 43 and 44 to fit into and out of a corresponding pair of the coaxial holes 38 in the platform side flanges 31 and 32 when opposite ends of the arms are turned toward or away from one another in the second angular motion. FIG. 3 illustrates the arms 43 and 44 moved together at their upper ends so that the pins are inserted into a registered pair of holes 38. In FIG. 4 the arms 43 and 44 are shown moved apart at their upper ends so that the arms 43 and 44 of the brace 22 are free to be turned together in the same plane about the rod 33. This permits a different selected pair of holes 38 to be engaged by the pins 40 and 41.

Each of the pins 40 and 41 is spring-biased into retracted position by compression springs 46 and 47. In addition the ends of the arms 43 and 44 opposite the pins 40 and 41 are spring-biased by a tension spring 48, attached between the arm 43 and the body of the brace 22, so as to bias the pins 40 and 41 away from one another in the second angular motion described above.

The ends of the arms 43 and 44 opposite the pins 40 and 41 are also interconnected by linkage comprising a manually turnable central link 50 pivotable at its midpoint on the brace and a pair of outer links 51 and 52 pivotably connecting the ends of the central link 50 with the corresponding ends of the arms 43 and 44 opposite the pins 40 and 41. The brace 22 also includes a cover element 53 which serves as a mounting means for one end of the tension spring 48 and provides a pivot for the central link 50. More importantly, however, the cover 53 overlies the linkage to prevent inadvertent turning of the central link 50.

The platform 21 may serve as a surface upon which an article such as a bucket may be mounted. This is illustrated in FIG. 1 by a bucket or pail 55. Centering brackets 56 and 57 may be located in opposite positions on the platform base 30 and they may be adjustable to conform to buckets of various diameter. A pair of straps 58 may extend upwardly from the base 30 and be connected by turnbuckles 59 to finger elements 60 which can be fitted over the upper edge of buckets of various height to hold the bucket securely in place.

It will be apparent from the foregoing description of a preferred embodiment of the invention that it provides a platform assembly having adjustment means which are very easy to manipulate and operate. It requires only a turning of the central link 50 to move the pins 40 and 41 between their locked and unlocked position, and to that end the central link 50 may be provided with a kind of wing element 54 easily grasped between thumb and fingers. However, the adjustment means are located beneath the cover 53 in a position where inadvertent turning of the central link 50 is virtually impossible. Since the platform 21 is supported by the pins 40 and 41 at the spaced flanges 31 and 32 of the platform, optimum four-point stability is provided for the platform. Various modifications may be made to the platform assembly of the invention which are within the scope of the following claims.

I claim:

1. In a platform assembly for a slanted ladder wherein a base is to be hooked to and lie against rungs of the ladder, a platform is hinged to the base, and a brace is pivoted to the platform to abut the base and hold the platform and base at an included angle which substantially levels the platform, adjustment means for varying said included angle to accomodate different ladder angles comprising (a) a pair of parallel side flanges on the platform formed with respective arrays of holes in registry with one another and with each array describing an arc about a common axis which is also the pivot axis of the brace on the platform, and (b) a pair of coaxial pins on the brace movable simultaneously in opposite directions away from one another into a corresponding pair of coaxial holes in the respective side flanges to fix the platform and brace at a predetermined included angle and toward one another out of said pair of holes to permit the brace to be pivoted on the platform side flanges so that the pins can register with a different selected pair of registered holes.

2. A platform assembly according to claim 1 wherein a fixed shaft extends between the platform side flanges and through a pair of co-planar arms on the brace, the arms being moveable on the shaft to permit a first angular motion together around the shaft and a second angular motion toward and away from one another in the plane of the shaft, said pins exteding laterally from corresponding ends of the arms to fit into and out of a corresponding pair of coaxial holes in the platform side flanges when opposite ends of the arms are turned toward or away from one another in said second angular motion, the pins being operable within any selected pair of said holes by turning the brace and arms around the shaft in said first angular motion.

3. A platform assembly according to claim 2 wherein the ends of the arms opposite the pins are spring-biased toward one another to bias the pins away from one another in said second angular motion into a selected pair of coaxial holes.

4. A platform assembly according to claim 2 wherein the ends of the arms opposite the pins are interconnected by a linkage comprising a manually turnable central link pivotable at its midpoint on the brace and a pair of outer links pivotably connecting the ends of the central link with the corresponding ends of the arms opposite the pins.

5. A platform assembly according to claim 4 wherein the brace includes cover means overlying said linkage for preventing inadvertent turning of said central link.

* * * * *